US009814298B2

(12) United States Patent
Paduano et al.

(10) Patent No.: US 9,814,298 B2
(45) Date of Patent: Nov. 14, 2017

(54) LOADING AND RETRIEVAL SYSTEM FOR ITEMS STORED IN A PACK

(71) Applicant: The North Face Apparel Corp., Wilmington, DE (US)

(72) Inventors: Matthew Edward Paduano, Orinda, CA (US); Christopher K. Tagumi, Oakland, CA (US)

(73) Assignee: The North Face Apparel Corp., Wilmington, DE (US)

( * ) Notice: Subject to any disclaimer, the term of this patent is extended or adjusted under 35 U.S.C. 154(b) by 53 days.

(21) Appl. No.: 14/735,979

(22) Filed: Jun. 10, 2015

(65) Prior Publication Data

US 2016/0360863 A1 Dec. 15, 2016

(51) Int. Cl.

| | |
|---|---|
| ***A45F 3/04*** | (2006.01) |
| *A45C 13/02* | (2006.01) |
| *A45F 3/00* | (2006.01) |

(52) U.S. Cl.

CPC ..... *A45F 3/04* (2013.01); *A45C 2013/025* (2013.01); *A45F 2003/001* (2013.01); *A45F 2200/0525* (2013.01)

(58) Field of Classification Search

CPC ..... A45F 3/04; A45F 2200/0525; A45F 2003/001; A45C 2013/025; Y10S 206/804

USPC ..... 224/196, 642, 644, 645, 242, 245

See application file for complete search history.

(56) References Cited

U.S. PATENT DOCUMENTS

| | | | | |
|---|---|---|---|---|
| 1,994,235 A | | 3/1935 | Solomon | |
| 6,102,266 A | * | 8/2000 | Chacon | A45F 5/00 224/661 |
| 6,935,497 B1 | * | 8/2005 | Domotor | A45C 13/02 206/224 |
| 8,151,981 B2 | * | 4/2012 | Nordstrom | A45C 7/0077 206/254 |
| 2004/0188202 A1 | | 9/2004 | Chuang | |

(Continued)

FOREIGN PATENT DOCUMENTS

| | | | |
|---|---|---|---|
| EP | 1201150 | A1 | 5/2002 |
| GB | 590234 | A | 7/1947 |

(Continued)

OTHER PUBLICATIONS

Extended European Search Report in Application No. 16175917.0 dated Oct. 31, 2016.

(Continued)

*Primary Examiner* — Adam Waggenspack
(74) *Attorney, Agent, or Firm* — Ganz Pollard LLC

(57) ABSTRACT

A pack having a body defining a volume for the containment of items. The body has a height, width, and depth, and, optionally, at least one body strap coupled to the pack body. An elevator system is associated with a compartment of the pack. The elevator system includes: (i) a cradle that is movable upwardly and downwardly in the compartment and which is configured with a support portion to receive an item storable in the compartment; and (ii) a coupling system that couples the cradle to a user grasp element disposed on the pack. The pulling of the grasp element lifts the cradle from a lower position in the compartment to a raised position. The raising of the cradle is sufficient to allow a stored item that is enclosable in the compartment to protrude from the compartment.

21 Claims, 12 Drawing Sheets

(56) References Cited

U.S. PATENT DOCUMENTS

| | | | | |
|---|---|---|---|---|
| 2009/0071782 | A1 | 3/2009 | Rasmussen | |
| 2011/0198374 | A1* | 8/2011 | Majeau | A45F 3/04 224/245 |

FOREIGN PATENT DOCUMENTS

| | | | |
|---|---|---|---|
| JP | 2007514213 | | 5/2007 |
| JP | 2014511743 | | 5/2014 |
| WO | 2009072981 | A1 | 6/2009 |
| WO | 2012143521 | A1 | 10/2012 |

OTHER PUBLICATIONS

Japanese Office Action in Japanese Patent Application No. 2015-256240 dated Jan. 19, 2017.

* cited by examiner

LOADING AND RETRIEVAL SYSTEM FOR ITEMS STORED IN A PACK

BACKGROUND

The inventive subject matter is generally directed to packs, such as wearable packs like backpacks, daypacks, rucksacks, knapsacks, bike messenger bags, and other carriers of packed items like suitcases, travel cases, duffel bags, and brief cases. It is particularly directed to a loading and retrieval system for items to be stored or stored in a pack.

Packs have been long known. They have one or more compartments for storage of a user's items. Typically, the compartments are secured by closure systems such as zippers, drawstring systems, snap fasteners, hook-and-loop fasteners, etc. The design of packs and closure systems is such that opening and accessing a compartment is manually intensive. The front and back portions of the pack may collapse onto one another, requiring manual separation to add items into pack or to sort through items already in the pack. Such effort causes delay and frustration in storing or retrieving items.

In modern times, security checkpoints confront us at airports, courthouses, concert venues, and other facilities. They are places where rapidity is needed to keep pace with the queue. Delays in retrieving and storing items in the process of security clearances can be especially stressful. Prior art designs for wearable packs disadvantageously do not facilitate ease of access to items stored in compartments in packs. Accordingly, there is a need for improved packs that efficiently allow items to be placed in and retrieved from compartments.

SUMMARY

The inventive subject matter is generally directed to a pack having a body defining a volume for the containment of items, and an integrated system for loading and retrieving the items to be stored or stored in the pack.

In certain embodiments, the inventive subject matter is directed to a pack that includes a body defining a volume for the containment of items, the body having a height, width, and depth. An elevator system is disposed within a compartment of the pack, the elevator system comprising (i) a cradle that is movable upwardly and downwardly in the compartment and which is configured with a support portion to receive an item storable in the compartment, and (ii) a coupling system that couples the cradle to a user grasp element disposed on the pack so that the pulling of the grasp element lifts the cradle from a lower position in the compartment to a raised position, the raising of the cradle being sufficient to allow a stored item that is enclosable in the compartment to protrude from the compartment.

In the foregoing and other embodiments: The compartment may comprise a first vertical surface, a second vertical surface, and a bottom surface. Each surface is on a wall of the compartment. The first and second vertical surfaces are spaced apart and extend upwardly from the bottom surface. The cradle has a first side that is coupled to the first vertical surface, and a second side that is movably coupled to the coupling system, and the item support portion of the cradle is disposed between the first and second vertical surfaces. In the foregoing and other embodiments, the coupling system may be movably coupled to the first and/or the second vertical surface. In certain embodiments, the first side has a joint with the relevant wall that is oriented orthogonally to the direction the cradle moves up and down in the compartment, and the joint is spaced a predetermined height from the bottom of the compartment. The predetermined height may be at least 1, 2, 3, 4, 5, 6 or more inches. In a lowered position, the support portion of the cradle may rest against at least a portion of the bottom surface. However, by suspending some distance above the bottom surface, the cradle offers impact resistance against against shock for the object suspended in the cradle. The first vertical surface may be a side of the pack that is intended to face away from the wearer of the pack.

In the foregoing and other embodiments: The pack may have an openable top surface that, with the other surfaces, forms a complete enclosure for the compartment. The pack may also open at side or bottom surfaces, as well. The pack may be a wearable pack. A wearable pack may have a pair of shoulder straps coupled to the body of the pack.

In the foregoing and other embodiments: The coupling system may be disposed in one or more channels. The cradle may be a pliable material. A pair of body straps comprising shoulder straps may be coupled to a vertical wall. The opening for the compartment with the stored item may be a main compartment of the pack. Or the opening may be for a secondary compartment of the pack. The compartment for the stored item may be sufficiently sized and shaped to hold a laptop or tablet computer. The cradle may include a cushioning material such as a cellular foam material. The pack may include a ramp surface associated with an interior surface of the pack that is configured to engage a stored item as it moves upwardly in the pack, moving the item more centrally within an opening for the compartment. The pack may include an automatic return associated with the cradle, the automatic return automatically repositioning the cradle to a lowered position when a user releases the user grasp element after raising the stored item.

In certain embodiments, the inventive subject matter is directed to a method of making a pack, comprising: providing a body defining a volume for the containment of articles, the body having a height, width, and depth, and at least one body strap coupled to the body; providing the pack with an elevator system disposed within a compartment of the pack, the elevator system comprising (i) a cradle that is movable upwardly and downwardly in the compartment and which is configured with a support portion to receive an item storable in the compartment, and (ii) a coupling system that couples the cradle to a user grasp element disposed on the pack so that the pulling of the grasp element lifts the cradle from a lower position in the compartment to a raised position, the raising of the cradle being sufficient to allow a stored item that is enclosable in the compartment to protrude from the compartment.

These and other embodiments are described in more detail in the following detailed descriptions and the figures.

The foregoing is not intended to be an exhaustive list of embodiments and features of the inventive subject matter. Persons skilled in the art are capable of appreciating other embodiments and features from the following detailed description in conjunction with the drawings. Following is a more detailed description of various inventive lines under the inventive subject matter. The appended claims, as originally filed in this document, or as subsequently amended, are hereby incorporated into this Summary section as if written directly in.

BRIEF DESCRIPTION OF THE DRAWINGS

The appended figures show embodiments according to the inventive subject matter, unless noted as showing prior art.

DETAILED DESCRIPTION

Figure 1:
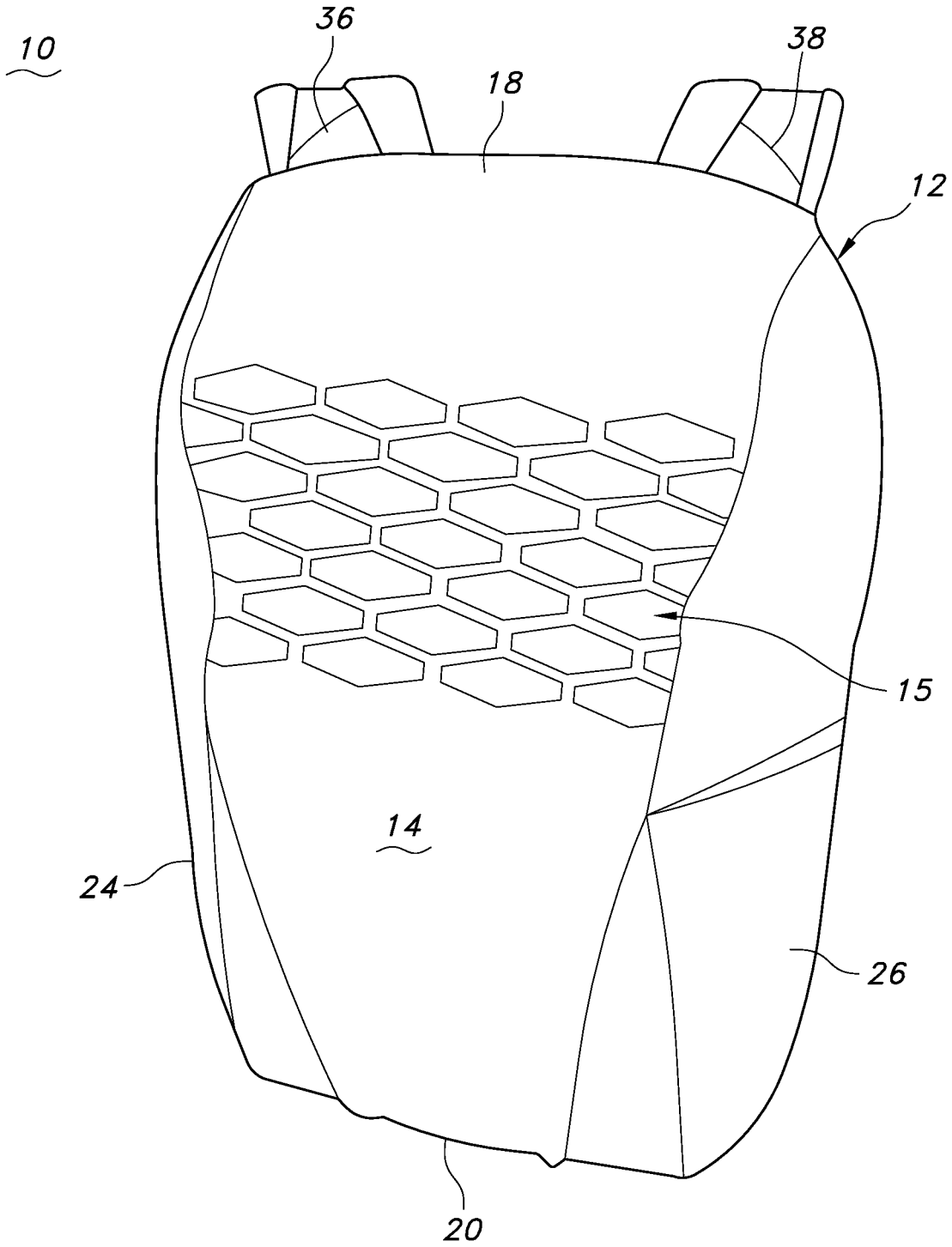
FIG. 1 shows a front view of a pack.
Figure 2:
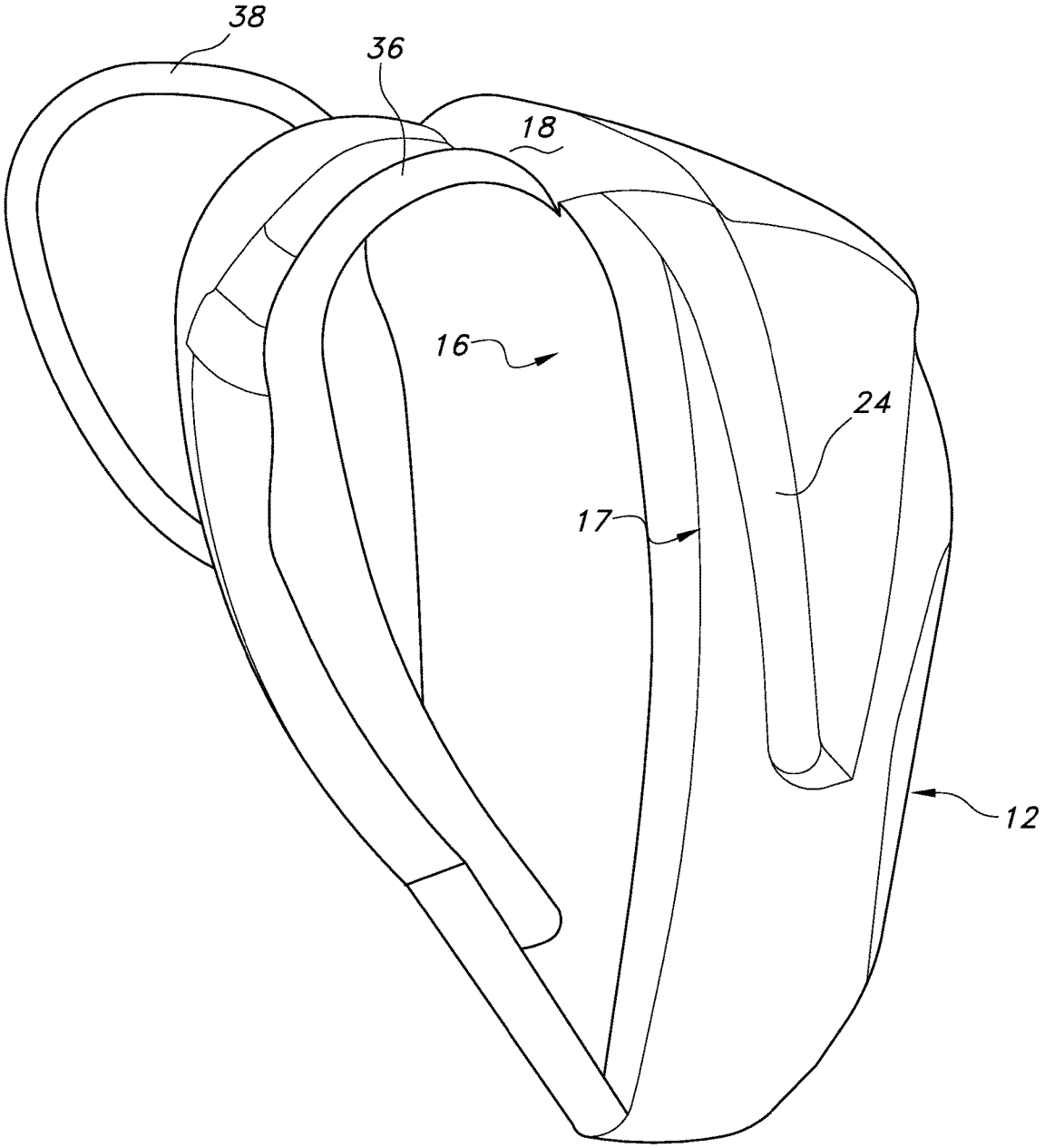
FIG. 2 shows a left side, rear perspective view of the pack of FIG. 1.
Figure 3:
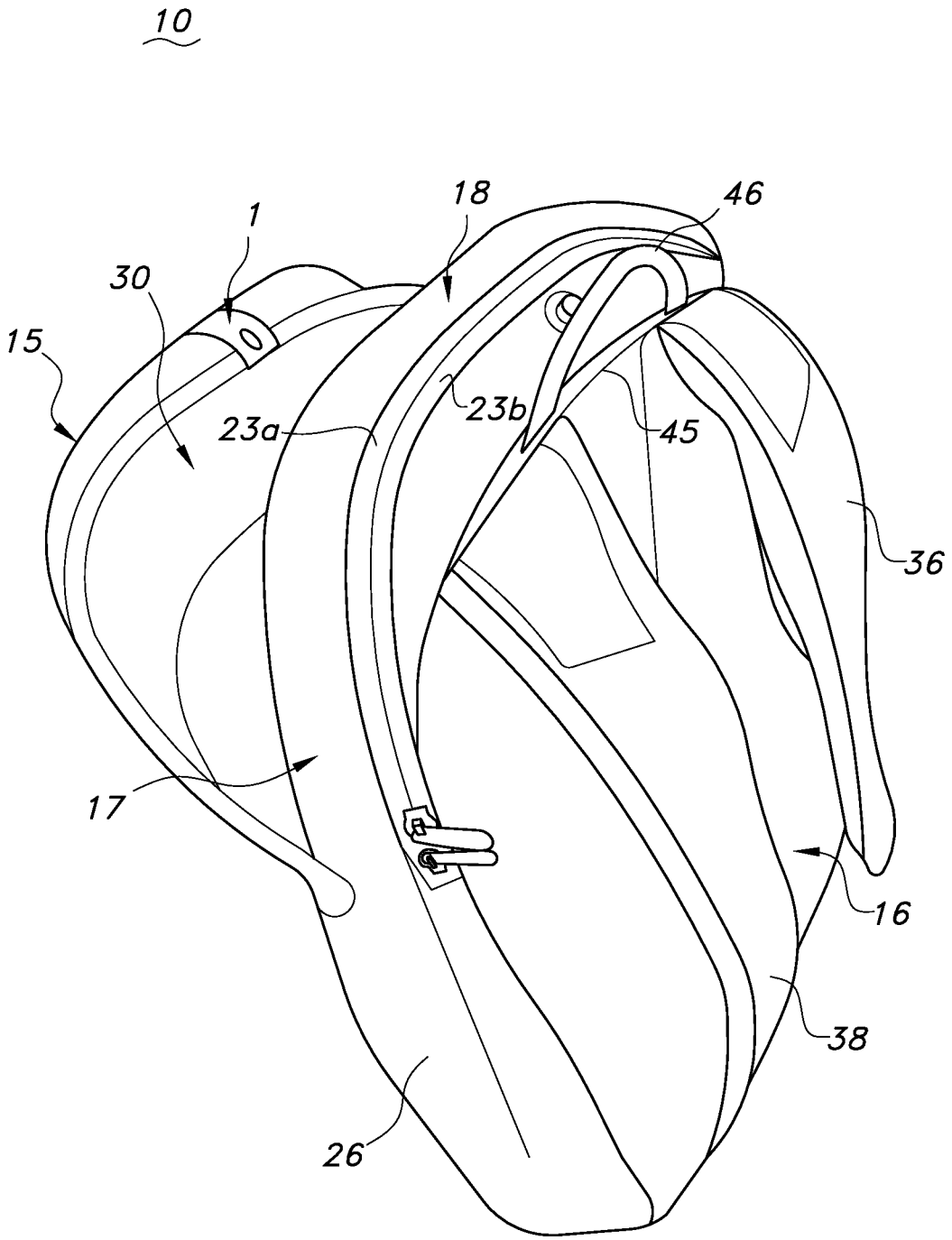
FIG. 3 shows rear, right side perspective view of the pack of FIG. 1.
Figure 4:
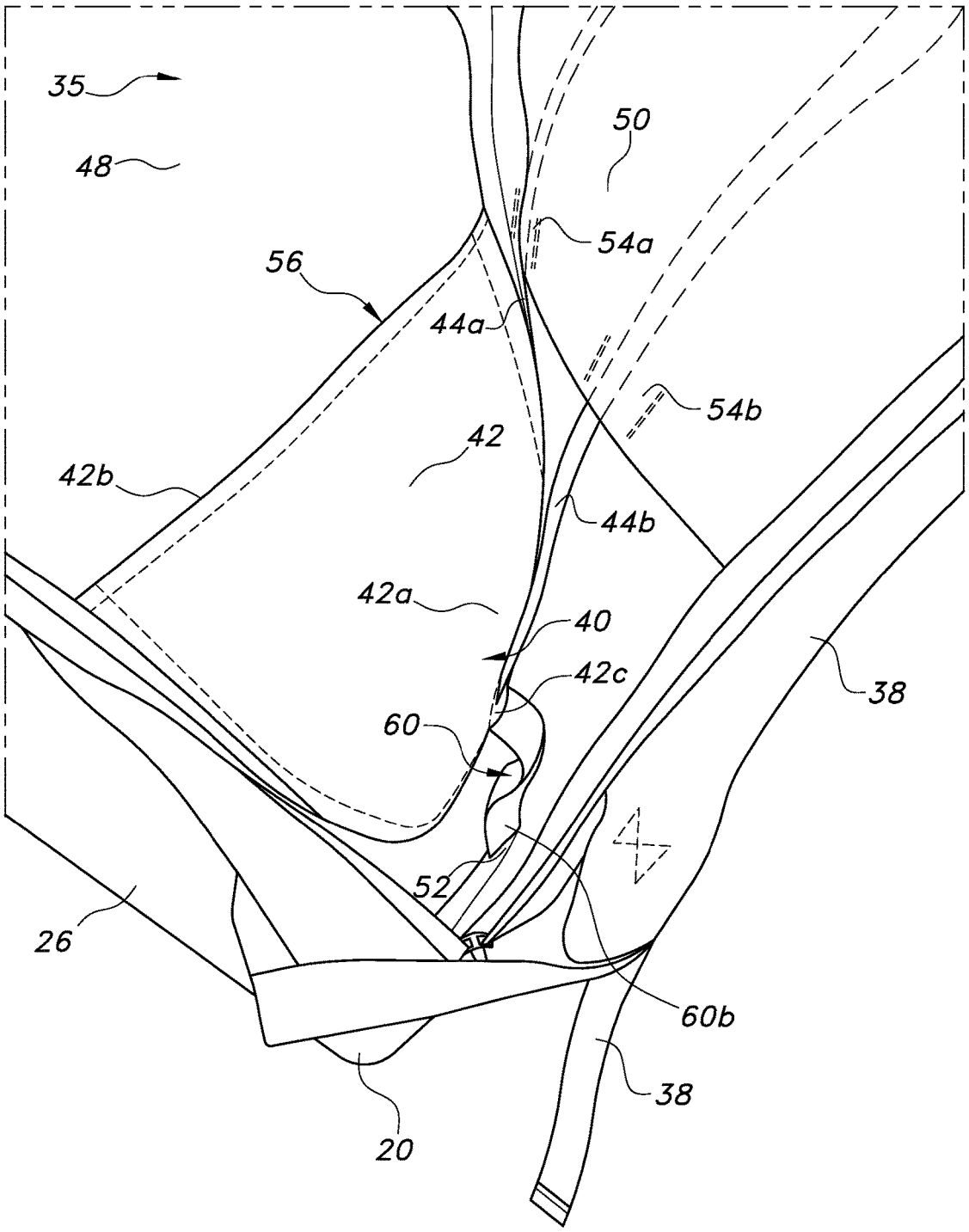
FIG. 4 shows right a side perspective view of a lower portion of an open compartment in the pack FIG. 1.
Figure 5:
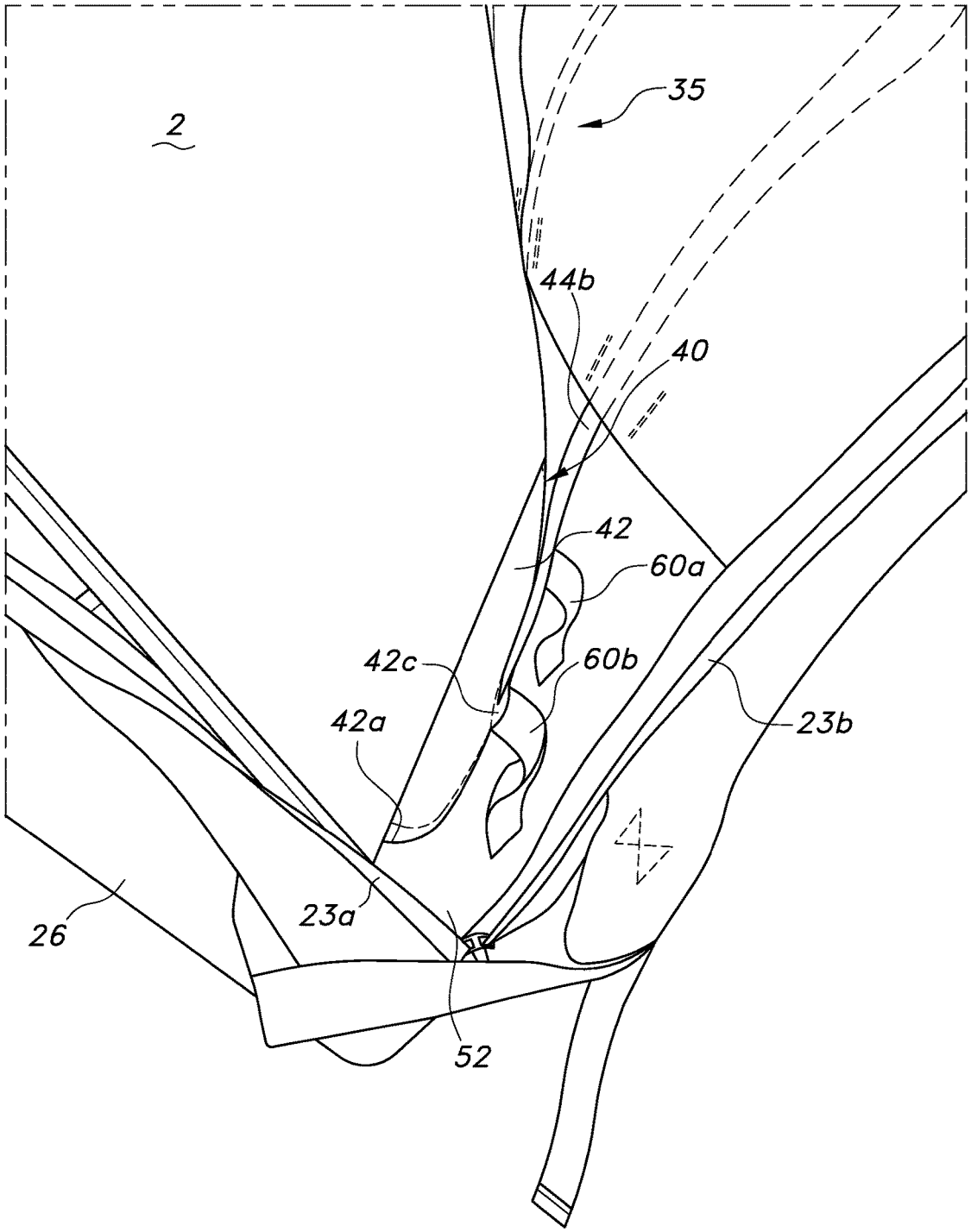
FIG. 5 shows the compartment of FIG. 5 with an item stored on a cradle system in a lowered position.

Representative embodiments according to the inventive subject matter are shown in FIGS. 1-12, wherein the same or generally similar features share common reference numerals.

Persons skilled in the art will recognize that many modifications and variations are possible in the details, materials, and arrangements of the parts and actions that are described and illustrated herein, and that such modifications and variations do not depart from the spirit and scope of the teachings and claims contained therein.

The inventive subject matter is generally directed to a pack having a body defining a volume for the containment of items. The body has a height, width, and depth, and, optionally, at least one body strap coupled to the pack body. An elevator system is associated with a compartment of the pack. The elevator system includes: (i) a cradle that is movable upwardly and downwardly in the compartment and which is configured with a support portion to receive an item storable in the compartment; and (ii) a coupling system that couples the cradle to a user grasp element disposed on the pack. The pulling of the grasp element lifts the cradle from a lower position in the compartment to a raised position. The raising of the cradle is sufficient to allow a stored item that is enclosable in the compartment to protrude from the compartment.

The term "wearable pack", as used herein, refers broadly to wearable packs with shoulder straps, along the lines of backpacks, rucksacks, daypacks, hip packs, messenger bags, totes and other packs with one or more shoulder straps. "Backpack", unless context indicates otherwise, means a pack with a pair of shoulder straps. A pack that does not self-support on the body via a body-retaining strap or other support is not a wearable pack. For example, a suitcase with only a handle is a pack that is not wearable.

FIGS. 1-8 illustrate one possible embodiment of a pack 10, which in this case is a backpack. The embodiment shown will generally be used to illustrate the inventive subject matter, although the inventive subject matter is not to be limited by them. The body 12 of the pack 10 has an overall construction of at least a front surface 14, a back surface 16, a top surface 18, a bottom surface 20, and side surfaces 24 and 26 that interconnect with the other surfaces. The arrangement of the surfaces defines one or more volumes, i.e., compartments, for containment of articles. In the context of surfaces 14, 16, 18, 20, 24, and 26, the term "surfaces" is used broadly to mean a generally sheet- or panel-like structure with a side that faces outward and a side that faces inward when assembled into the body of the pack. The surfaces need not come together in discrete joints; they may merge in curving interfaces, for example. Typically, the surfaces are made of a pliable material, such as one or more layers of a knit or a woven or non-woven textile, but the pack may be made in whole or part of shape-holding, semi-rigid or rigid materials, such as plastics, polymer foams, metals, and/or composites.

In at least the case of backpacks, the body is generally sized and shaped so that it fits comfortably against the back of the wearer. In some cases, it may be contoured to conform to the contours of anatomy of a back. Generally, it is dimensioned so as not to exceed about the width of the back, or the length between the hips and shoulders of the intended wearer. Backpacks may be sized and shaped differently to accommodate variations in height, e.g., small, medium, or large. Or they may be sized and shaped to fit gender or age categories, e.g., men, women, or children.

Notably, the top side or bottom side surfaces or both could be essentially eliminated in whole or part from a pack by merging together the top edges of the front surface 14 and back surface 16, and/or the bottom edges of the front surface 14 and the back surface 16, creating wedges (not shown) where the surfaces join. Similarly, surfaces could be reduced in profile by using curves, for example, to merge surfaces. The side surfaces 24 and 26 could also be joined or merged in similar fashion. The surfaces are not necessarily continuous surfaces—zippers, netted sections, and cords may interrupt them for example.

Typically, the body of a pack includes a closeable opening 1 for access to a compartment in the pack. In the embodiment shown, opening 1 provides access at the top of the pack to a main compartment 30. The opening may extend down one or both sides of the pack to a desired degree. The opening may be secured in the closed condition by a closure system 23*a*, 23*b*, such as a mechanism based on interlocking male/female parts, e.g., snaps; a zipper; hook and loop fasteners; buttons, etc.

The opening is created by the separation of a portion of the pack from another portion. The Figures show a front portion 15 of the pack being movable from a back portion 17. The pack may have frame elements that help support the pack in a desired configuration. In doing so, the hingeable section is more easily aligned with the back portion for closure. The frame element may be semi-rigid to allow some resilient flexibility to the back but still generally holding a compartment in a desired shape.

In addition to the main compartment, the body may include any number of other compartments for containment of articles. Other compartments may be arranged adjacent, side-to-side or up and down relative to the main compartment or to each other. The body, including any of its compartments, may also have pockets arranged on the inside or outside of the compartments. For example, a pocket (not shown) may also be arranged on the front of body 12. As used herein, "compartments" refers to relatively large areas for holding things such as, sleeping bags, laptops, articles of clothing, books, etc. Generally, "pockets" refers to relatively smaller areas for holding things, such as wallets, mobile phones, media players, water bottles, etc. However, there is not always a clear dividing line between what a compartment is and what a pocket is, beyond the main compartment of a pack.

Figure 7:
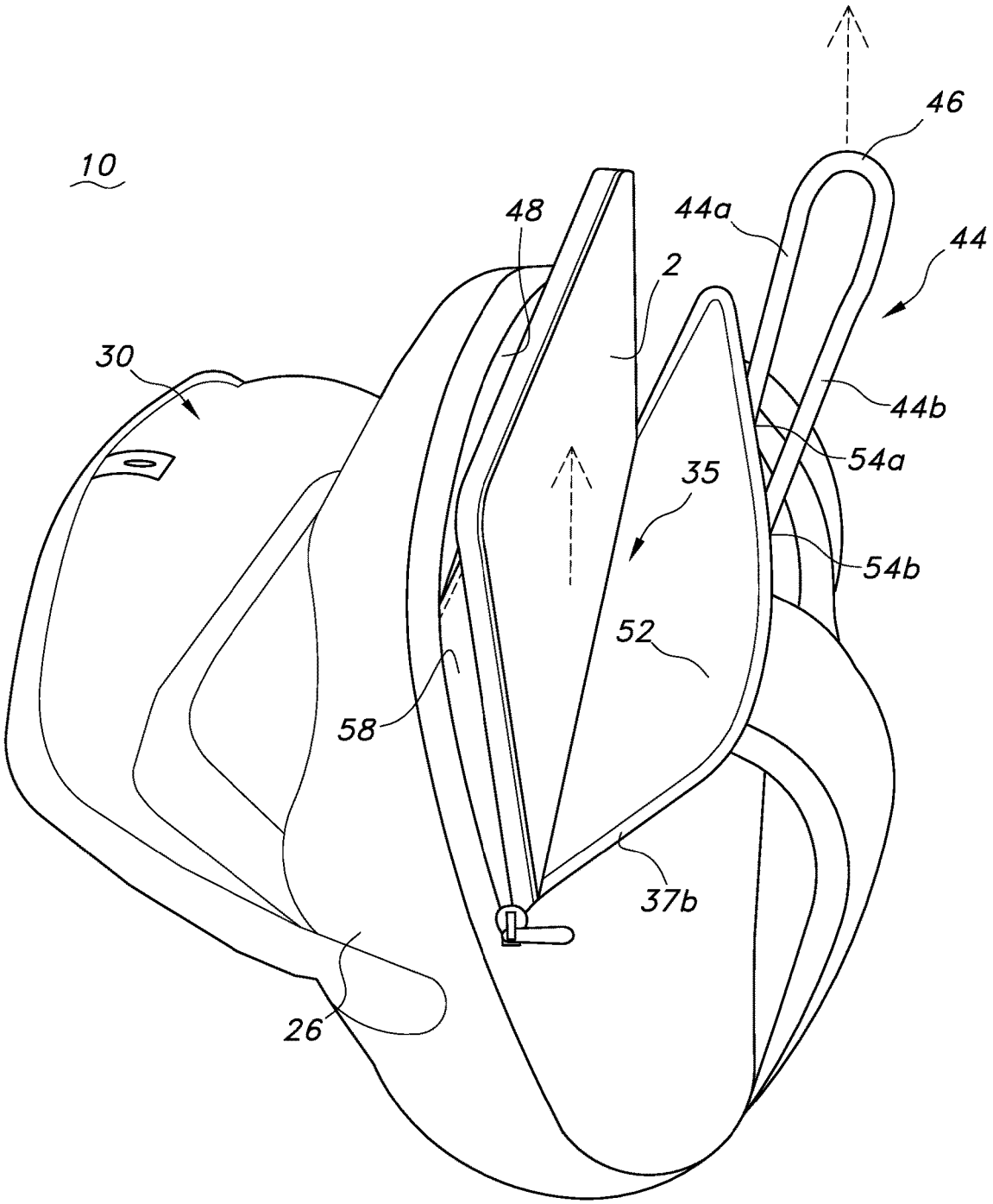
FIG. 7 shows the item of FIGS. 4-6 raised from the lower position.

FIG. 7 shows an optional backside-accessible compartment 35, separated from the main compartment 30, for storing an object such as a laptop 2. In the embodiment shown, compartment 35 is a dedicated compartment for storing a generally planar item, such as a laptop or tablet computer (hereinafter, collectively referred to as a "device"). The compartment may be accessed by, for example, a zipper system 23*a*, 23*b*, which may run from part way up one side, around the top, to part way down the other side. The laptop compartment zipper is away from the straps, so access is secure yet easy. In general, compartment for a laptop or tablet computer should be configured to have a size that stores and encloses a device with minimum dimensions of 20 cm (height) by 12 cm (width) by 5 mm (depth). It should be understand, the laptop or tablet storage compartment could be the main compartment or any other suitable compartment and the discussion herein of the elevator system applies to any such compartment. It should also be understood that the elevator system may be used not only with devices but with other kinds of stored items as well.

An elevator system 40 is associated with a compartment of the pack to raise or lower items from the compartment. The elevator system includes: (i) a cradle 42 that is movable upwardly and downwardly in the compartment and which is configured with a support portion 42*a* to receive an item storable in the compartment and (ii) a coupling system 44, having left 44*a* and right 44*b* portions, that couples the cradle to a user grasp element 46 disposed on the pack. The pulling of the grasp element lifts the cradle from a lower position in the compartment to a raised position. The raising of the cradle is sufficient to allow a stored item that is enclosable in the compartment to protrude from the compartment, as seen in FIG. 7.

The grasp element 46 can be disposed inside or outside the pack and on any portion of the pack. For example, a user may first need to open the compartment to the pack to find the grasp element at the interior side of the opening.

Compartment 35 in which the elevator system 40 is disposed has a first vertical surface 48, a second vertical surface 50, and a bottom surface 52 (all interior surfaces). The first and second vertical surfaces are spaced apart and extend upwardly from the bottom surface. The cradle 42 has a first side 42*b* that is coupled to the first vertical surface, and a second side that is movably coupled to the coupling system. However, this is an example and the coupling system may be movably coupled to the first and/or second vertical surface. The support portion 42*a* of the cradle is disposed between the first and second vertical surfaces.

The coupling system may route directly up to the grasp element or it could indirectly route to the grasp element, for example, by taking bends or turns. The coupling system 44 may be based on one or more coupling elements. In the embodiment shown, the coupling elements are straps or bands 44*a*, 44*b*. In the embodiment shown, the coupling system's strap or band that has a generally U-shape. The legs 44*a*, 44*b* of the U route in channels 54*a*, 54*b* formed in the body of the pack to the cradle. The legs extend upwardly through the channels and out apertures in the body of the pack, merging into the closed end of the U. The closed end is blocked from being pulled downwardly by abutting against surface 45, 145 disposed between the channels. The closed end serves as the grasp element. This is an example where the grasp element has an integrated construction with the coupling system. Alternatively, each leg can be a separate band of material that connects to a separate grasp element. The legs may be made of an elastic material to assist in returning the cradle to a lower position when the grasp element is released.

Figure 8:
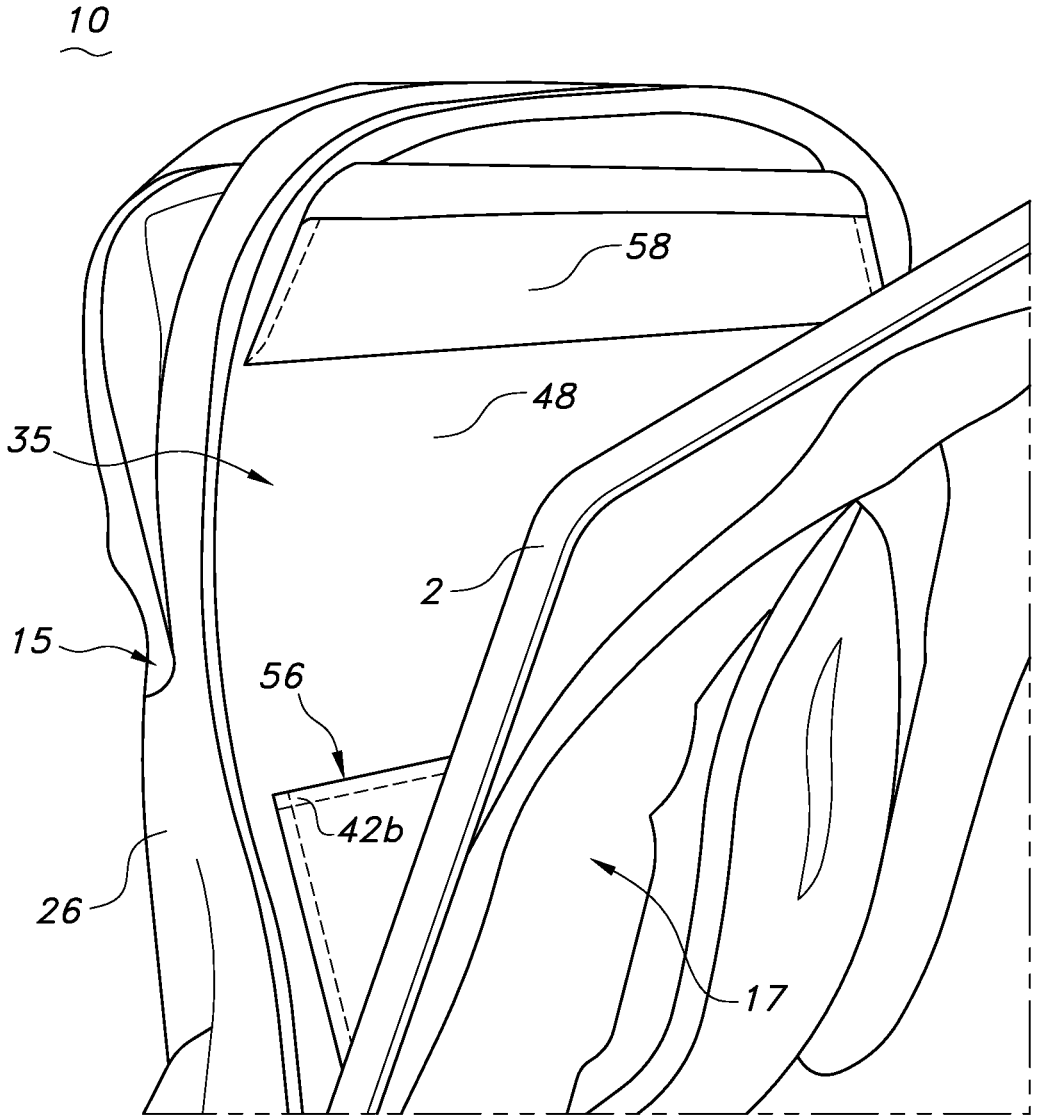
FIG. 8 shows a ramp on an interior vertical surface for the compartment of FIGS. 4-7.
Figure 9:
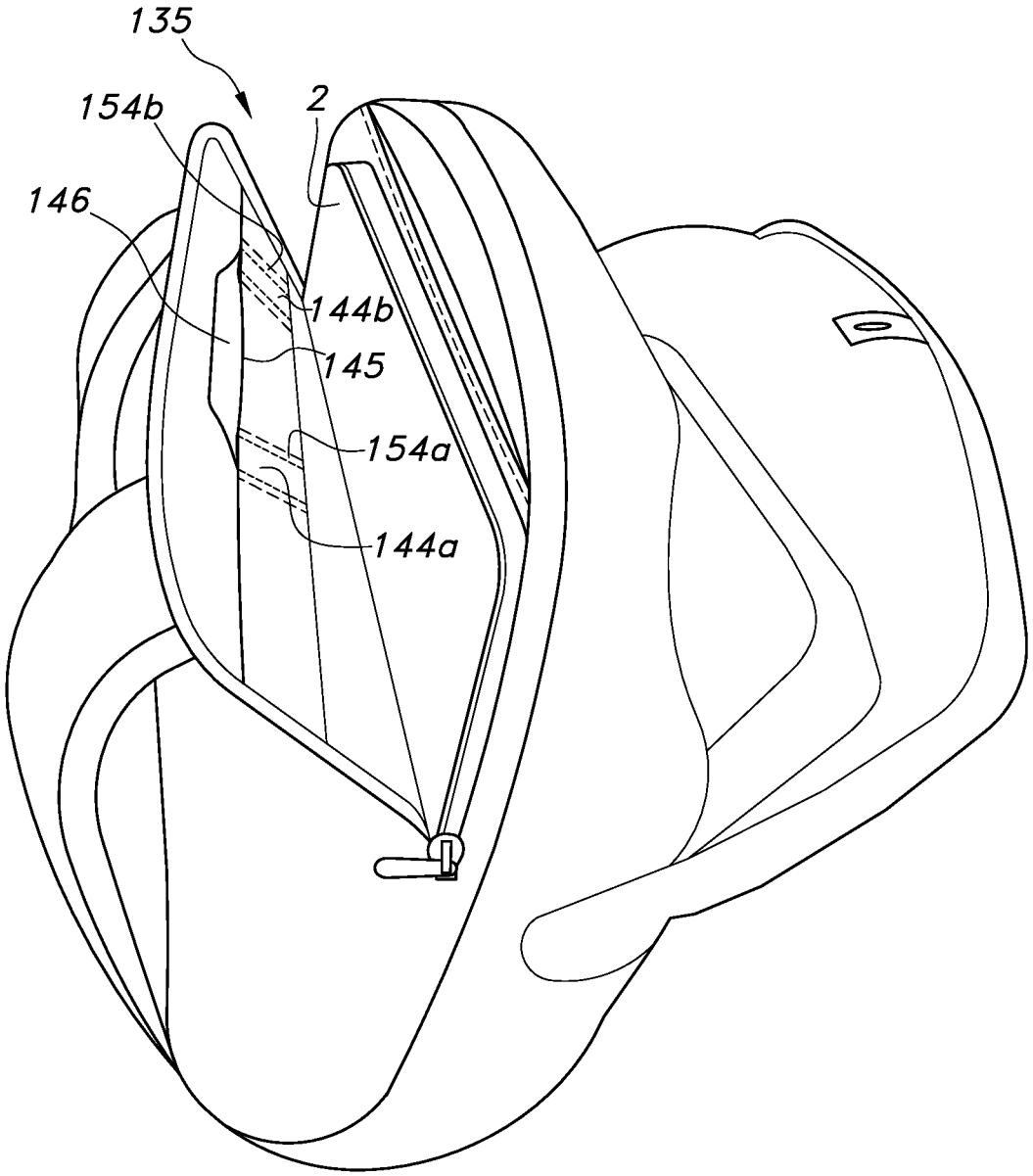
FIG. 9 shows a top, left side perspective view of a pack compartment with an alternative embodiment of a grasp in a first, lowered position.
Figure 10:
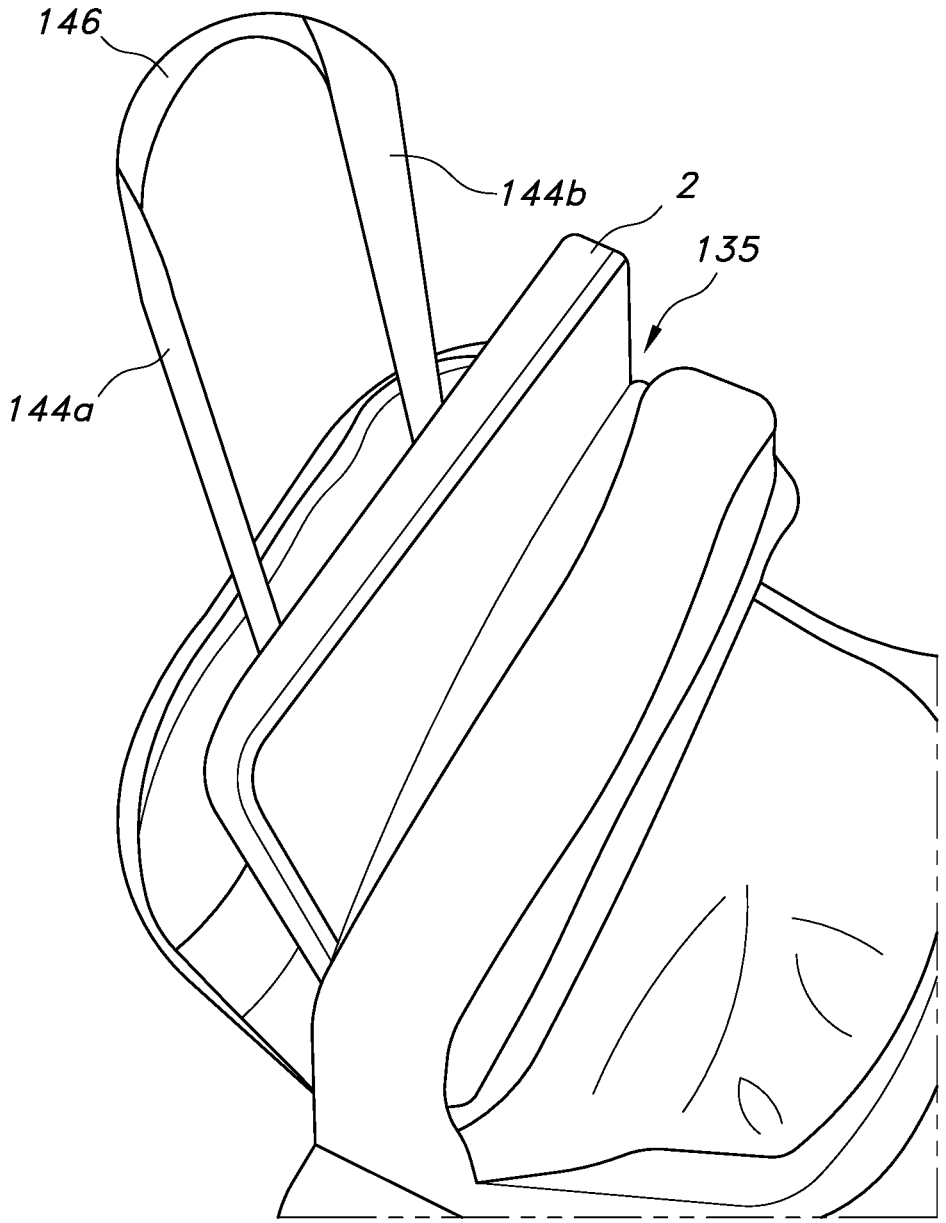
FIG. 10 shows the compartment with the grasp element in a second, raised position.

FIG. 9 shows a top, left side perspective view of a pack compartment with an alternative embodiment of a grasp in a first, lowered position. In this example, the grasp element 146 is stored on the inside of a compartment 135 but is otherwise generally similar to the embodiment shown in FIGS. 1-8. Like the embodiment of FIGS. 1-8, it has legs 144*a*, 144*b* that run through channels 154*a*, and 154*b*, extending from the top of the pack downwardly. FIG. 10 shows the compartment with the grasp element 146 in a second, raised position.

Figure 11:
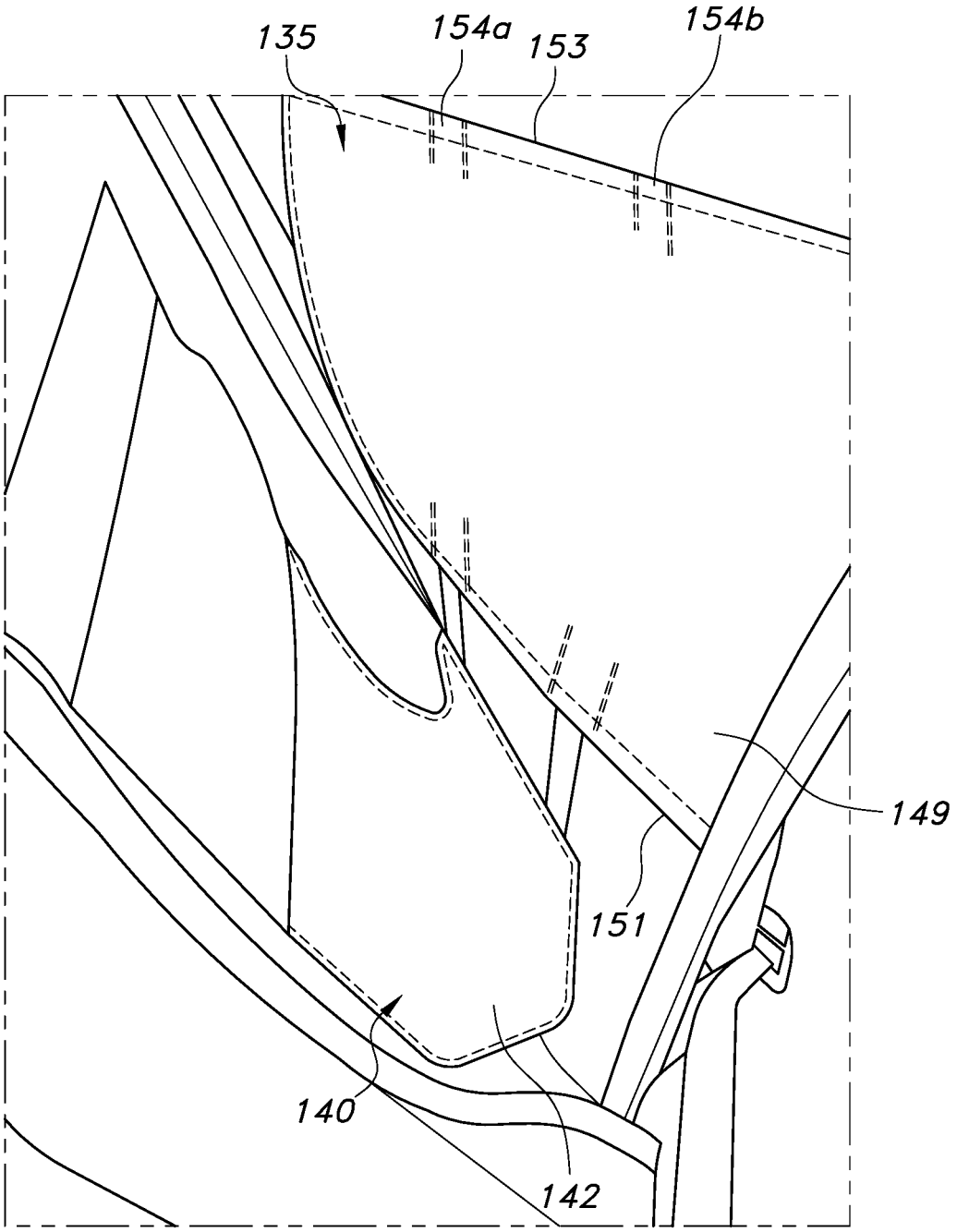
FIG. 11 shows a left side perspective view of the compartment of FIG. 9 with a cradle system that is coupled to the grasp element in a lower position.
Figure 12:
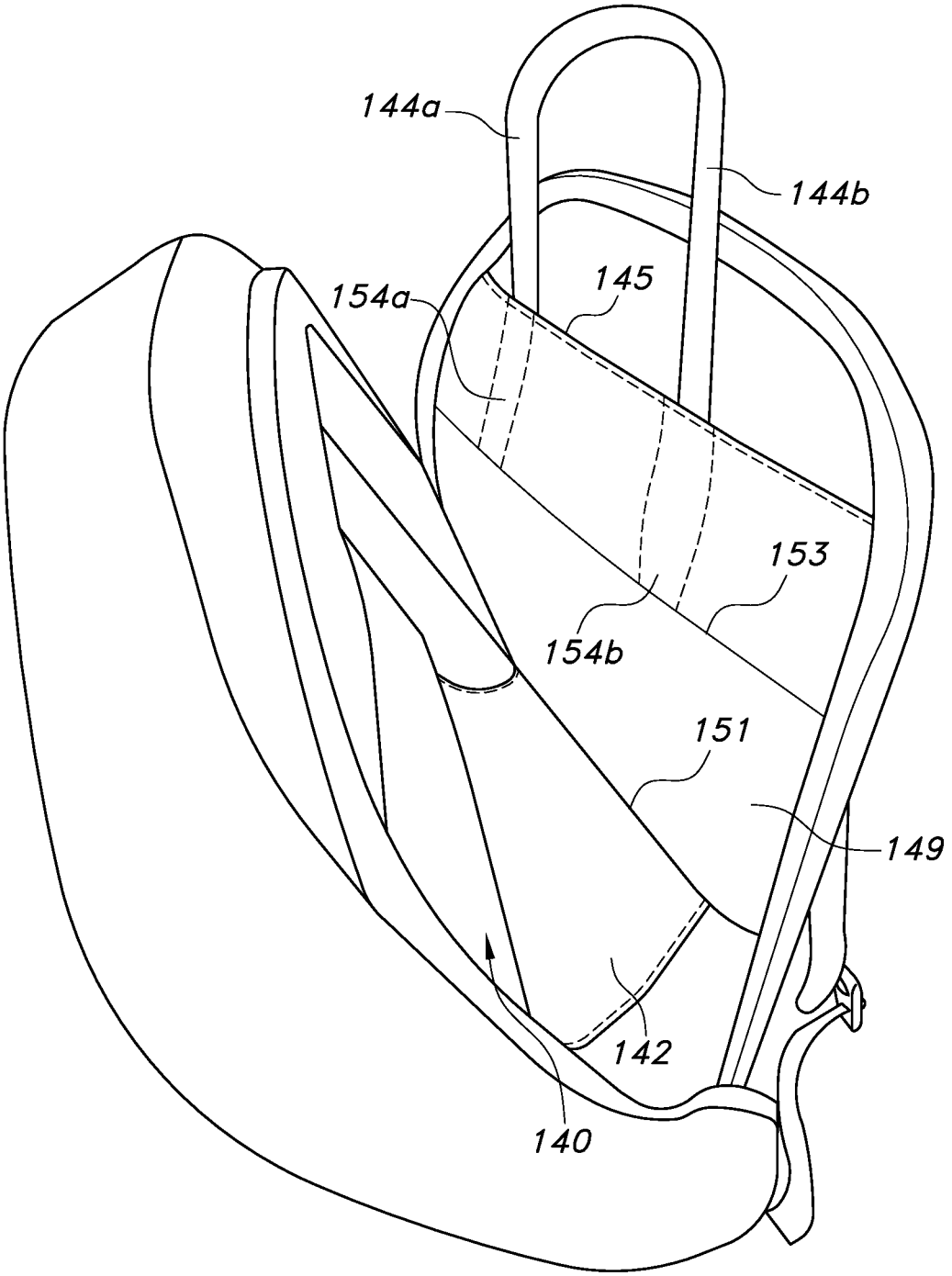
FIG. 12 shows a left side perspective view of the compartment of FIG. 9 with a cradle system that is coupled to the grasp element in a raised position.

FIG. 11 shows a left side perspective view of the compartment of FIG. 9 with an elevator system 140 that is coupled to the grasp element in a lower position. FIG. 12 shows a left side perspective view of the compartment of FIG. 10 with a cradle system that is coupled to the grasp element in a raised position. The compartment includes a sleeve 149 that has a lower edge 151 that is open to receive the free side of cradle 142. Accordingly, a first portion of the cradle may be pulled upwardly in between the sleeve and the body of the pack. The opposite side 153 of the sleeve is closed, except for where straps 144*a* and 144*b* enter channels 154*a*, 154*b* at the top of the sleeve, so that an abutment surface is provided to limit the travel of cradle.

In the embodiment shown, compartment 35 has an openable top surface that with the other surfaces forms a complete enclosure for the compartment. The cradle is a pliable, generally planar form. It has a first side that is connected to vertical surface 48. The line of connection is a hingeable joint 56 with the wall that is oriented orthogonally to the direction the cradle moves up and down in the compartment. The joint is spaced a predetermined height from the bottom surface 52 of the compartment 35. In some embodiments, in a lower most position, the support portion of the cradle rests against at least a portion of the bottom surface 52 of the pack. In other embodiments, the support portion of the cradle is configured or adjustable to suspend a stored item above an underlying surface for shock resistance. In either case, the height of joint 56 from the bottom surface corresponds to the height the storable item is liftable from the bottom of the pack or its suspended height. A suitable height for many applications is at least 1 inch. In other embodiment, the cradle may be a more rigid structure that serves as platform or tray for raising or lowering an item. The cradle need not have an edge connected to a wall or other structure. It could be a free element that raises or lowers in the compartment. For example it could be rectangular tray with a coupling element at each corner. The coupling systems could be routed to the same grasp element or different grasp elements. For example, a pair of opposing coupling elements could be coupled to a first grasp element and another pair of opposing elements could be coupled to a second grasp element. Pulling both grasp elements evenly would evenly raise the platform or tray. Or pulling just one could raise just a corner or side of the platform or tray.

The coupling elements in a coupling system are not limited to pliable bands, straps, cables, etc. They can be mechanical linkages as well.

In some embodiments, the first vertical surface 48 is on the portion of the pack 10 that is intended to face away (is not against) from the back of the wearer when the pack is worn. Joint 56 is on that surface. A free edge 42*c* of cradle 42 is adjacent second vertical surface 50, which is on the portion of the pack which faces (goes against) the wearer's back. The coupling system couples to the free edge and routes upwardly along the second vertical surface to the top of the pack. In this embodiment, a pair of body straps comprising shoulder straps is coupled to the exterior side of the second vertical wall 50.

To cushion a sensitive item such as a laptop or tablet computer, the cradle may be made at least in part of a shock absorbing material such as a layer of cellular. The elevator system may be configured so that the cradle does not rest on the bottom surface of the pack. It could be raised so that storable item, while being enclosed in the compartment, is suspended above the bottom surface to provide protection against shock. The coupling elements in a coupling system may be elastic to absorb or dampen shocks.

Figure 6:
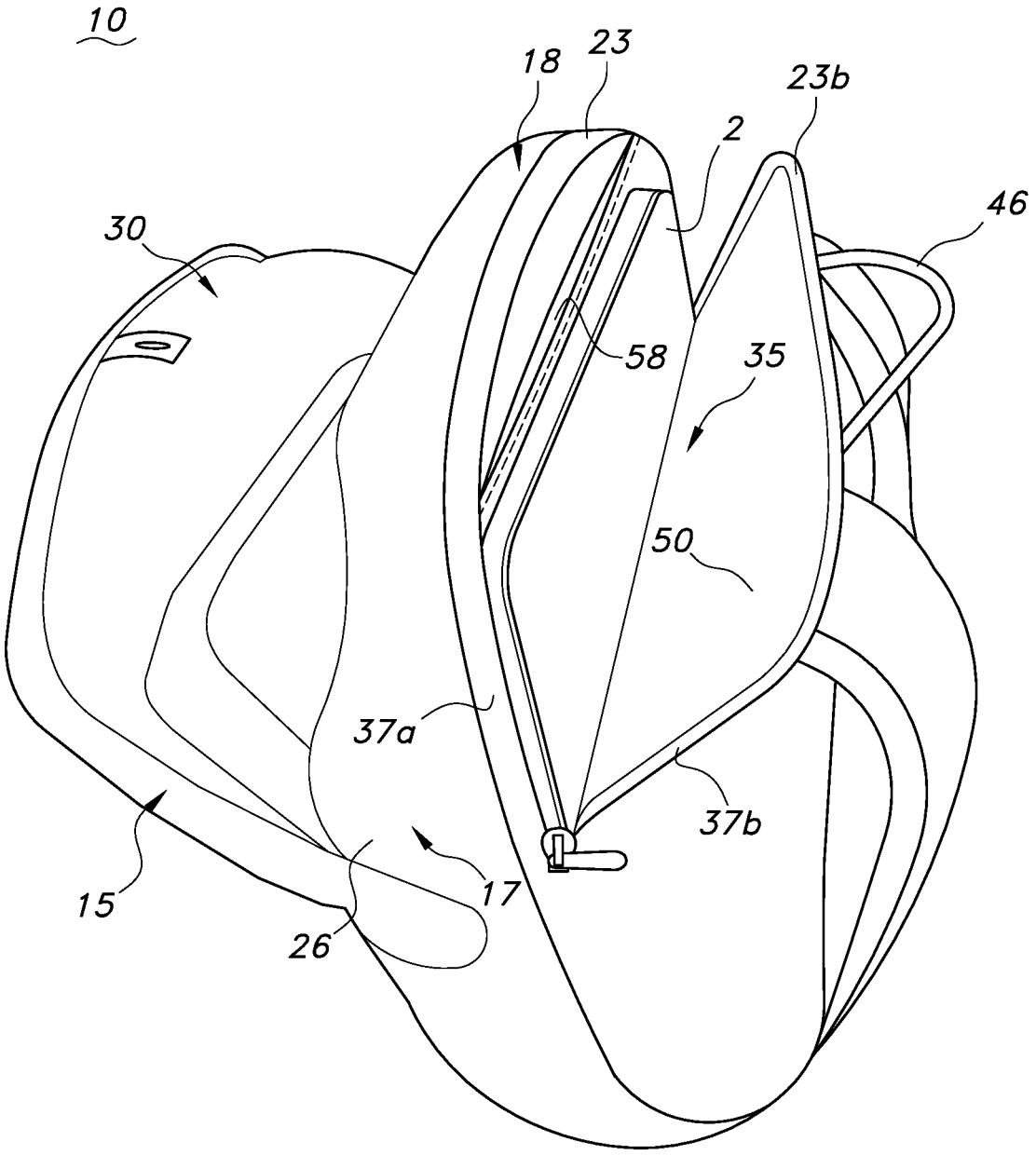
FIG. 6 shows the pack of FIGS. 4-5 at a top portion of the compartment.

The pack may include an optional ramp 58 to facilitate the movement of a stored item such as laptop 2 in to the opening of the compartment. Referring to FIGS. 6-8, a vertical wall such as vertical wall 48 may include a ramp in the form of an angled surface 58 that engages the stored item as it is lifted upwardly in its cradle 42. As the laptop engages the ramp, it moves the item more centrally into the compartment's opening.

Another optional feature is an automatic return system 60 associated with cradle 42. The return exerts a spring or elastic return force on the cradle as it is lifted via grasp 46. Once grasp 46 is released, the return force acts on the cradle to reseat it in its lowered position. In the embodiment shown, the return system comprises two elastic bands or straps 60*a* and 60*b* that are coupled to opposite sides of the cradle 42 at or near the free edge 42*c* at one set of ends and to the bottom surface 52 of the pack at the opposite set of ends.

The inventive subject matter also contemplates methods of making and using a pack with the inventive elevator system. A method may be providing a body defining a volume for the containment of articles, the body having a height, width, and depth, and at least one body strap coupled to the body; and providing the pack with an elevator system disposed within a compartment of the pack, the elevator system comprising (i) a cradle that is movable upwardly and downwardly in the compartment and which is configured with a support portion to receive an item storable in the compartment, and (ii) a coupling system that couples the cradle to a user grasp element disposed on the pack so that the pulling of the grasp element lifts the cradle from a lower position in the compartment to a raised position, the raising of the cradle being sufficient to allow a stored item that is enclosable in the compartment to protrude from the compartment. In such a pack, the compartment may have a first vertical surface, a second vertical surface, and a bottom surface, the first and second vertical surfaces being spaced apart and extending upwardly from the bottom surface, and the cradle has a first side that is coupled to the first vertical surface, and a second side that is movably coupled to the coupling system, and the item support portion of the cradle is disposed between the first and second vertical surfaces; wherein the coupling system is movably coupled to the second vertical surface; and wherein an openable top surface that with the other surfaces forms a complete enclosure for the compartment. In such a pack, the first side of the cradle may be in a joint with the wall that is oriented orthogonally to the direction the cradle moves up and down in the compartment, and the joint is spaced a predetermined height from the bottom of the compartment.

The body strapping systems coupled to the wearable pack may be discrete items connected to the body or integrated structures with the body that are, for example, woven, knitted or molded in a unitary form with the body portion of the pack. The strap system may be a pair of shoulder straps, as is known in conventional backpacks, or a long, single strap that is configured to fit over one shoulder of and across a wearer's chest and under the arm opposite the shoulder, as is known in the case of bike messenger bags, for example. As used herein, "strap" is meant to refer to not only pliable, webbing and band-like structures but also individual filaments or bundles of filaments, chains, cords, cables, etc. that provide the functionality for the purposes described herein. A strap may have an elastic or inelastic construction. It may also have a construction of elastic and inelastic sections. The backpack shown in the figures includes one or more shoulder straps, in the illustrated example, straps 36 and 38. The shoulder strap system can be based on single-ply straps of material or they can be a composite of materials, as is known in higher-end backpacks for carrying heavier loads. Often, the portion of the shoulder strap that bears against a wearer's body is made using a padded or cushioning material or construction. For example, it may be a composite of a cellular foam material, such as polyurethane, molded or cut EVA foam (ethylene-vinyl acetate), padded mesh—often known as nylon or polyester spacer mesh-surrounded by or joined to a fabric such as nylon.

In addition to, or in place of, the shoulder straps for carrying the body of the pack on the body of a wearer, the pack may also optionally include a handle 22.

The body 12 of a pack may be constructed of one or more plies of thin, pliable material. Typical pliable materials for use in the body include, natural and synthetic materials, Nylon fabrics, polyester fabrics, natural or synthetic rubber or rubber-like plies of material, animal hides (e.g., leather), cotton, canvas, hemp, wool, and fabric blends. These materials can be used singly or in combination with each other. The body may be formed using materials having continuous surfaces such as Nylon plain weave or twill fabric or perforated surfaces such as net or web structures.

Frame elements may be associated with the pliable materials or other body forming materials by incorporating them between layers or by affixing them on exterior or interior surfaces of the materials. Further, a panel or portion of the pack may be monolithically molded or otherwise formed of a rigid material to provide a rigid or semi-rigid structure.

The principles described above in connection with any particular example can be combined with the principles described in connection with any one or more of the other examples. Accordingly, this detailed description shall not be construed in a limiting sense, and following a review of this disclosure, those of ordinary skill in the art will appreciate the wide variety of systems that can be devised using the various concepts described herein. Moreover, those of ordinary skill in the art will appreciate that the exemplary embodiments disclosed herein can be adapted to various configurations without departing from the disclosed principles.

As used herein, unless context indicates otherwise, "coupling" (and variations of the word) means parts or portions of different functions that are physically connected separate items or physically formed as integrated or unitary structures.

The previous description of the disclosed embodiments is provided to enable any person skilled in the art to make or use the disclosed innovations. Various modifications to those embodiments will be readily apparent to those skilled in the art, and the generic principles defined herein may be applied to other embodiments without departing from the spirit or scope of this disclosure. Thus, the claimed inventions are not intended to be limited to the embodiments shown herein, but are to be accorded the full scope consistent with the language of the claims, wherein reference to an element in the singular, such as by use of the article "a" or "an" is not intended to mean "one and only one" unless specifically so stated, but rather "one or more".

All structural and functional equivalents to the elements of the various embodiments described throughout the disclosure that are known or later come to be known to those of ordinary skill in the art are intended to be encompassed by the features described and claimed herein. Moreover, nothing disclosed herein is intended to be dedicated to the public regardless of whether such disclosure is explicitly recited in the claims. No claim element is to be construed as "a means plus function" claim under US patent law, unless the element is expressly recited using the phrase "means for" or "step for".

The inventors reserve all rights to the subject matter disclosed herein, including the right to claim all that comes within the scope and spirit of the following claims:

The invention claimed is:

1. A pack, comprising:

a body defining a volume for the containment of items, the body having a height, width, and depth;

an elevator system disposed within a compartment of the pack, the elevator system comprising (i) a cradle that is movable upwardly and downwardly in the compartment and which is configured with a support portion to receive an item storable in the compartment, and (ii) a coupling system that couples the cradle to a user grasp element disposed on the pack so that the pulling of the grasp element lifts the cradle from a lower position in the compartment to a raised position, the raising of the cradle being sufficient to allow a stored item that is enclosable in the compartment to protrude from the compartment;

wherein the compartment comprises a first vertical surface, a second vertical surface, and a bottom surface, the first and second vertical surfaces being spaced apart and extending upwardly from the bottom surface, and the cradle has a first side that is coupled to the first vertical surface, and a second side that is movably coupled to the coupling system, and the item support portion of the cradle is disposed between the first and second vertical surfaces; and wherein the second vertical surface includes a sleeve extending from a lower portion of the second vertical surface to an upper portion of the second vertical surface, the sleeve being configured to receive the second side of the cradle, the second side being movable within the sleeve from a lower portion of the sleeve to an upper portion of the sleeve, the upper portion of the sleeve having an abutment surface that limits the vertical travel of the second side of the cradle so that it does not extend beyond the upper portion of the sleeve.

2. The pack of claim 1 wherein the coupling system is movably coupled to the cradle and channels are provided in the sleeve to facilitate the coupling.

3. The pack of claim 2 further comprising an openable top surface that with the other surfaces forms a complete enclosure for the compartment.

4. The pack of claim 1 wherein the first side has a joint with the wall that is oriented orthogonally to the direction the cradle moves up and down in the compartment and the joint is spaced a predetermined height from the bottom of the compartment.

5. The pack of claim 1 wherein the pack comprises a wearable pack.

6. The pack of claim 5 further comprising a pair of shoulder straps coupled to the body of the pack.

7. The pack of claim 4 wherein the predetermined height is at least 1 inch.

8. The pack of claim 4 wherein in a lower position the support portion of the cradle rests against at least a portion of the bottom surface.

9. The pack of claim 6 wherein the first vertical surface is on a portion of the pack that is intended to face away from the wearer of the pack when worn.

10. The pack of claim 1 wherein the coupling system is disposed in one or more channels.

11. The pack of claim 1 wherein the cradle comprises a pliable material.

12. The pack of claim 1 wherein a pair of body straps comprising shoulder straps are coupled to a vertical wall.

13. The pack of claim 3 wherein the opening is for a main compartment of the pack.

14. The pack of claim 3 wherein the opening is for a secondary compartment of the pack.

15. The pack of claim 3 wherein the opening is for a compartment of the pack sufficiently sized and shaped to hold a laptop or tablet computer.

16. The pack of claim 11 wherein the cradle comprises a cellular foam material.

17. A method of making a pack, comprising:

providing a body defining a volume for the containment of articles, the body having a height, width, and depth, and at least one body strap coupled to the body;

providing the pack with an elevator system disposed within a compartment of the pack, the elevator system comprising (i) a cradle that is movable upwardly and downwardly in the compartment and which is configured with a support portion to receive an item storable in the compartment, and (ii) a coupling system that couples the cradle to a user grasp element disposed on the pack so that the pulling of the grasp element lifts the cradle from a lower position in the compartment to a raised position, the raising of the cradle being sufficient to allow a stored item that is enclosable in the compartment to protrude from the compartment;

wherein the compartment comprises a first vertical surface, a second vertical surface, and a bottom surface, the first and second vertical surfaces being spaced apart and extending upwardly from the bottom surface, and the cradle has a first side that is coupled to the first vertical surface, and a second side that is movably coupled to the coupling system, and the item support portion of the cradle is disposed between the first and second vertical surfaces; and wherein the second vertical surface includes a sleeve extending from a lower portion of the second vertical surface to an upper portion of the second vertical surface, the sleeve being configured to receive the second side of the cradle, the second side being movable within the sleeve from a lower portion of the sleeve to an upper portion of the sleeve, the upper portion of the sleeve having an abutment surface that limits the vertical travel of the second side of the cradle so that it does not extend beyond the upper portion of the sleeve.

18. The method of claim 17 wherein the first side has a joint with the wall that is oriented orthogonally to the direction the cradle moves up and down in the compartment and the joint is spaced a predetermined height from the bottom of the compartment.

19. The pack of claim 1 further comprising a ramp surface associated with an interior surface of the pack that is configured to engage a stored item as it moves upwardly in the pack, moving the item more centrally within an opening for the compartment.

20. The pack of claim 1 further comprising an automatic return associated with the cradle, the automatic return automatically repositioning the cradle to a lowered position when a user releases the user grasp element after raising the stored item.

21. The pack of claim 1 wherein the cradle is configured to suspend the stored item above an underlying surface of the pack.

* * * * *